United States Patent [19]

Waite

[11] 4,318,663

[45] Mar. 9, 1982

[54] LEVELLING DEVICE FOR A MATERIAL HANDLING MEMBER

[75] Inventor: Jerry A. Waite, Racine, Wis.

[73] Assignee: J. I. Case Company, Racine, Wis.

[21] Appl. No.: 130,147

[22] Filed: Mar. 13, 1980

[51] Int. Cl.[3] ..... E02F 3/32

[52] U.S. Cl. ..... 414/707; 414/714; 414/728

[58] Field of Search ..... 414/694, 706–708, 414/712, 710, 714, 728

[56] References Cited

U.S. PATENT DOCUMENTS

| | | | |
|---|---|---|---|
| 3,239,083 | 3/1966 | Guinot | 414/469 |
| 3,259,259 | 7/1966 | Metailler | 414/469 |
| 3,952,890 | 4/1976 | Armstrong | 414/712 |
| 4,054,216 | 10/1977 | Inui et al. | 414/694 |

*Primary Examiner*—Robert W. Salfer

*Attorney, Agent, or Firm*—Dressler, Goldsmith, Shore, Sutker & Milnamow, Ltd.

[57] ABSTRACT

A mechanical linkage and hydraulic circuit are used to control the position of a material handling element. A bell crank and outrigger arm are joined between the boom and dipperstick of a backhoe linkage and the supporting frame. A relief valve discharges fluid pressure building up in the actuator between the support frame and the boom. The bell crank linkage and hydraulic circuit maintains the position of the material handling element along the grade by manipulating the dipperstick alone.

13 Claims, 4 Drawing Figures

LEVELLING DEVICE FOR A MATERIAL HANDLING MEMBER

DESCRIPTION

1. Technical Field

The invention relates to material handling boom assemblies wherein the material handling member is movable while maintaining an essentially fixed position relative to its support. An outrigger arm and bell crank linkage assembly is used to automatically maintain straight-line travel of the material handling member.

2. Background of the Invention

A backhoe is a machine for digging and moving the earth in which the bucket is drawn towards the machine to fill the bucket. A backhoe is sometimes called a pull shovel, or a pull hoe, a ditch shovel or a dipper shovel. Specifically, a boom is mounted on a tractor supported frame in such a manner that it can move upwardly and downwardly as well as from side to side relative to the frame. Pivotally mounted on the free end of the boom is a dipper stick which carries at its free end an excavating bucket or scoop. The boom and dipper stick are foldable and unfoldable relative to each other such that the bucket can be extended away from and retracted towards the supporting frame for excavating. Operation of the boom dipper stick and bucket is accomplished through hydraulic pistons and cylinders.

In ordinary backhoes, the dipper stick describes a circle about a pivot point on the associated boom. Accordingly, the bucket attached to the dipper stick also assumes circular motion. Therefore the path of the bucket is a circular arc when the dipper stick moves around the pivot point on the boom. If the boom which carries the dipper stick is moved in a vertical direction about its pivot point at the shovel's revolving frame, the bucket makes another circular motion. If the speeds of these motions, as a function of the path travelled by the bucket, are controlled, it is possible to produce essentially straight-line motion of the bucket. This is also possible, if one motion is carried through at a constant speed and if the other motion is regulated in its speed. If, in addition, the leading edge of the bucket or scoop is to be kept constant during the straight-line travel, it is necessary also to swing the bucket at an exactly controlled angular velocity at the dipper stick. From these basic considerations, it can be appreciated that in the operation of a backhoe unusual effort on the part of the machine, as well as physically on the part of the operator, is necessary to achieve straight-line travel of the bucket or scoop for any given single angle.

Accordingly, for any specifically selected straight-line travel of the bucket requires a unique set of manipulations. It can easily be appreciated that even in the case where the working motion of the bucket can be carried through very slowly and with great accuracy, that the accuracy of the work decisively depends on the operator's reactions and depth perception. Therefore, the working speed of the device of necessity has to be especially low to give the operator time to react so he can correct any deviation from a straight line. Impliedly this assumes the operator has recognized a need for correction and can perform this correction without unnecessarily deviating the tool from the specified line of travel.

Practically speaking, it is important to maintain a level trench when laying sewer lines and water supply lines. If the slope of the trench is not kept uniform, drainage is impaired. In the case of water supply lines, dips in the lines can lead to pocketing and water hammer. Many other systems require close control of trench depth and shape.

Several solutions have been proposed to this problem. F. R. Schwing (U.S. Pat. No. 3,656,640) uses a linkage tieing the dipper stick to the boom. That device, in practice, nevertheless requires small corrections to be applied by the equipment operator. Special hydraulic systems are used by R. L. Tweedale (U.S. Pat. No. 3,412,880) and D. L. Shook (U.S. Pat. No. 3,487,958). While special hydraulic systems can automatically keep the bucket level, they are relatively more expensive than a simple linkage. In addition, these systems are not readily adaptable to the existing equipment without some redesign.

Thus if a device could be easily added to a conventional backhoe that would improve the speed at which the bucket could be manipulated in an essentially straight line, the productivity of the operator and the machine would increase.

An obvious solution to this problem would be to increase the skill of the machine operator through training. Experience is also a factor effecting the productivity and the ability of the operator to manipulate his controls. It has been the experience of the inventor that the productivity of the machine cannot be readily increased by simply placing the burden on the operator especially when those operators are in so called "developing countries". In these areas of the world power driven excavating equipment is still a novelty. Equipment operators are relatively inexperienced and unskilled. A certain degree of skill and manual dexterity is required that can only come from years of training and experience. It would be wasteful to hold back the potential productivity of these machines while new skills and experience are developed. Therefore machines, which inherently increase worker productivity, will find an especially receptive market in developing countries.

SUMMARY OF THE INVENTION

The present invention modifies and improves a common backhoe design so as to enable that backhoe to have the capability of automatically digging a flat bottom trench. Specifically a new linkage is added. The linkage includes an outrigger arm and a bell crank. One end of the outrigger arm is mounted on the frame or body mounting the backhoe. The center of the bell crank is connected to the other end of the outrigger arm. One of the two ends of the bell crank is joined to the hydraulic cylinder operating the bucket. The other end of the bell crank is joined to the pivot point between the dipper stick and the boom. In addition, the hydraulic actuator operating the boom is modified by installing a relief valve whose set point has been lowered to a point such that the application of a force on the boom tending to compress the boom actuator results in the relief valve lifting to relieve the pressure thus allowing the boom to pivot relative to the frame to which it is mounted. When these modifications are made, the backhoe operator can position the bucket to the desired digging position along the trench previously dug by the backhoe and then by simply pulling the crowd or dipper stick control lever, the bucket will be forced to travel through a fill cycle without having to manipulate the bucket controls or the boom controls.

Once the bucket is filled, the backhoe operator would simply curl the bucket so as to retain the material contained therein and then by swinging the backhoe dipper stick upwardly, the bell crank and outrigger arm would maintain the bucket in a level position throughout the raising and dumping cycle. Thus, the linkage allows the operator to make his levelling pass in a trench by simply using a single control—the crowd or dipper stick control lever. This enables one to dig a flat bottom trench without completely depending upon the unusual depth perception and eye-hand control and coordination skills of the equipment operator often required in the operation of ordinary backhoes. Similarly, the linkage just described may be used in other material handling machines such as excavators and dipper shovels.

Numerous other advantages and features of the present invention will become readily apparent from the following detailed description of the invention and embodiments thereof, from the claims and from the accompanying drawings in which each and every detail shown is fully and completely disclosed as a part of this specification, in which like numerals refer to like parts.

DESCRIPTION OF THE PREFERRED EMBODIMENTS

Figure 1:
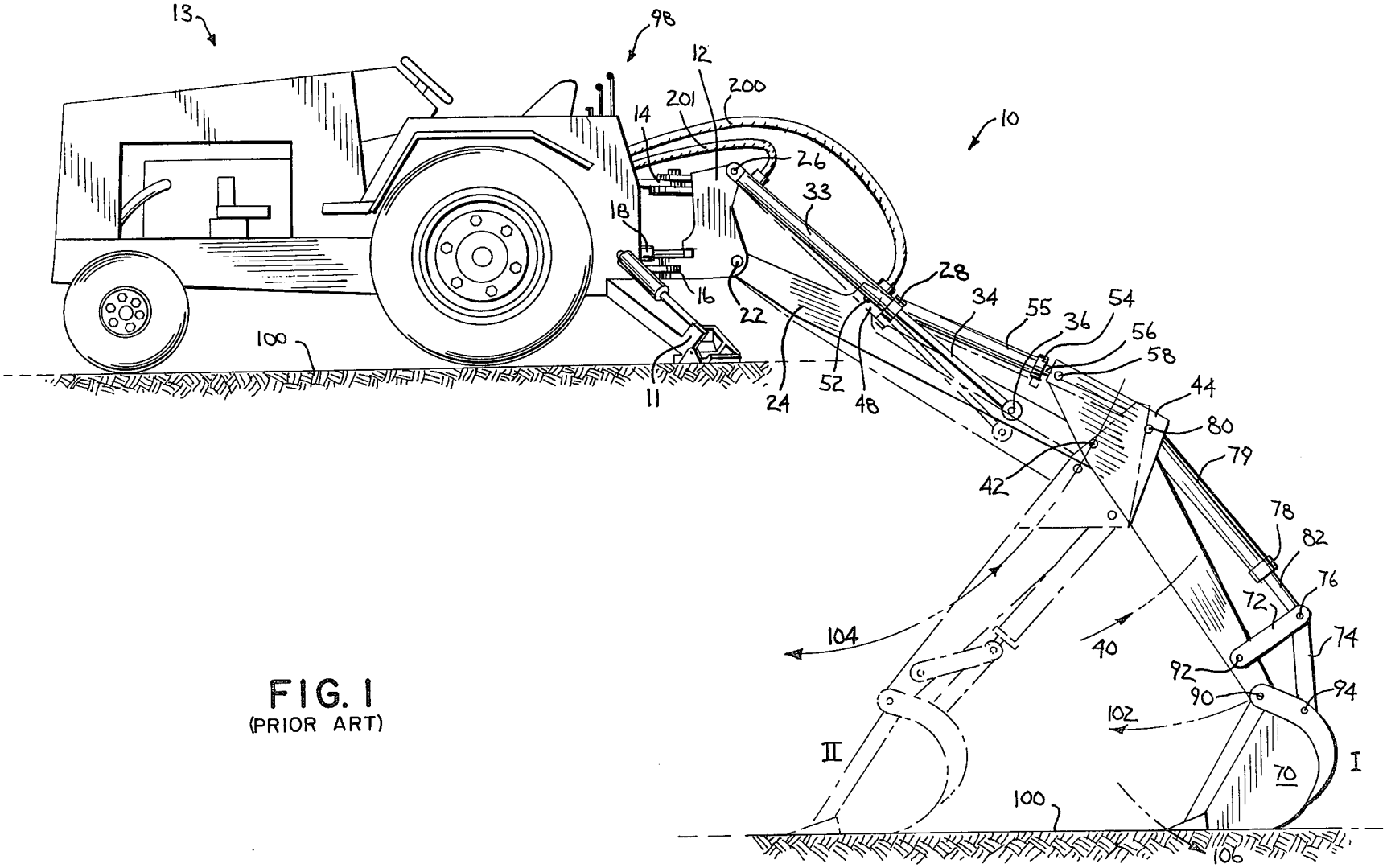
FIG. 1 (PRIOR ART)
FIG. 1 is a side elevation view of a backhoe showing implement arm in two positions where the working level of the bucket is below the tractor. The dotted lines indicate the relative position of the main components after the bucket has completed its travel across the surface being shovelled. This is a view of the PRIOR ART.

While this invention is susceptible to embodiment in many different forms, there is shown in the drawings and will herein be described in detail embodiments with the understanding that the present invention is to be considered as an exemplification of the principles of the invention and is not intended to limit the invention to the particular embodiment illustrated.

Referring now to the drawings, a backhoe assembly 10 is shown in FIG. 1 which is suitable for being pivotally mounted upon the rear of a tractor, (as disclosed in U.S. Pat. No. 3,376,984 to Long et al., which is hereby incorporated by reference insofar as it is not inconsistent with the present disclosure).

The backhoe assembly 10 (FIG. 1) includes a support attachment in the form of a swing tower 12 having upper and lower cylindrical openings 14 and 16 which receive swivel pins (not shown) to pivotally mount the swing tower 12 to a mounting bracket which projects rearwardly from a tractor 13. The swing tower 12 is positioned by two swing cylinder assemblies 18 (only one being shown).

The swing tower 12 forms a base or a frame supporting a bottom horizontal pivot shaft 22 joined to a boom 24 and an upper horizontal pivot shaft 26 joined to a boom cylinder assembly 28. The boom cylinder assembly or hydraulic drive 28 is of a double-acting type. It has a cylinder 33 and a piston rod 34. The piston rod 34 is pivotally connected to a shaft 36, located adjacent to but spaced from the free end of the boom, and is located adjacent to or along side of the boom 24.

A dipper stick assembly 40 is mounted on a pivot shaft 42 at one end of the boom 24. This mounting defines a pivot axis for the dipper stick at a location intermediate its length, but substantially closer to the boom end than to the bucket end of the dipper stick. The dipper stick assembly 40 includes a rigid attachment plate 44 which receives pivot shaft 42 and constitutes the boom end of the dipper stick assembly. A fluid ram means or hydraulic piston drive is employed to effect swinging movement of the dipper stick assembly. Referring to FIG. 1, a pair of brackets (only one being shown) 48 are mounted intermediate the boom, or may be integral therewith. The brackets are U-shaped in crosssection and have a space between the vertical walls. The bracket has a pivot shaft 52 extending therebetween.

The fluid ram means comprises a single dipper cylinder assembly 54, also of the doubleacting type. Dipper cylinder assembly 54 has a cylinder 55 and a piston rod 56 which is pivotally connected on a pivot shaft 58 carried at the end corner of the attachment plate 44 and which is axially spaced from pivot shaft 42. Dipper cylinder 55 is pivotally mounted on a pivot shaft 52 to bracket 48 on the boom 24.

A bucket 70 is pivotally attached to the free end of the dipper 40 in the conventional way. A pair of drive links 72, 74 are pivoted to the dipper 40 and bucket 70 and are interconnected by a floating knee shaft 76. A bucket cylinder assembly or hydraulic piston drive 78 of the double-acting type has a cylinder 79 mounted on a pivot shaft 80 carried on an upstanding corner of the dipper attachment plate 44 and has a single-ended piston rod 82 pivotally connected to the knee shaft 76.

Briefly recapitulating, the boom 24 is pivoted to the tower 12 at a pivot point 22. The boom 24 is manipulated by a hydraulic piston and cylinder assembly 28 pivotally connected at 36 to the boom 24 at one end and pivotally connected at 26 to the tower 12 at the other end. Similarly, the dipper stick 40 is pivoted at 42 to the boom 24. The dipper stick 40 is manipulated by hydraulic piston and cylinder assembly 54 pivotally connected at 52 to the boom 24 at one end and to a pivot 58 at the dipper stick 40 at the other end. Finally, the bucket 70 is pivoted to the dipper stick 40 at a pivot point 90 and to the pair of drive links 72 and 74. The bucket is rotated by a hydraulic piston and cylinder 78 interposed between and pivotally connected at 76 to the drive links 72 and 74 and pivotally connected at 80 to the dipper stick 40. The drive links 72 and 74 are connected to the dipper stick 40 at a pivot point 92 and to the bucket 70 at a pivot point 94.

Thus, the articulated linking of the bucket or scoop 70 to the dipper stick 40 and the boom 24 effectively provides for rotating the digging end 96 of the bucket 70 about 3 axes of rotation: the pivot point 22 for the boom; the pivot point 42 for the dipper stick; and the pivot point 90 for the bucket 70. Since the operator can manipulate his controls 98 to move the boom 24, the dipper stick 40 and the bucket 70 simultaneously, there is effectively created an infinite number of positions or centers of rotation for the digging end 96 of the bucket 70. Therefore, the direction of soil penetration or the direction of digging will not necessarily coinside with or be parallel to a line drawn tangentially to the digging edge 96 of the bucket 70.

In order for the digging edge 96 of the bucket 70 to be kept at a fixed angle or bite relative to the surface of the trench 100, the backhoe operator must effectively manipulate three controls 98 simultaneously. As shown in FIG. 1, to change the position shown in solid (I) to that position shown with the broken lines (II), the operator must manipulate his controls 98 so as to bring the dipper stick 40 rearwardly (arrow 102) or towards the tractor 13; raise and then lower (arrow 104) the boom 24; and extend (arrow 106) the bucket 70 relative to the end of dipper stick 40. Thus, it is plainly seen that this presents a difficult, if not, impossible task for the unskilled operator. A task that if it can be done at all, cannot be accomplished with repeated speed and accuracy.

Figures 2, 2A:
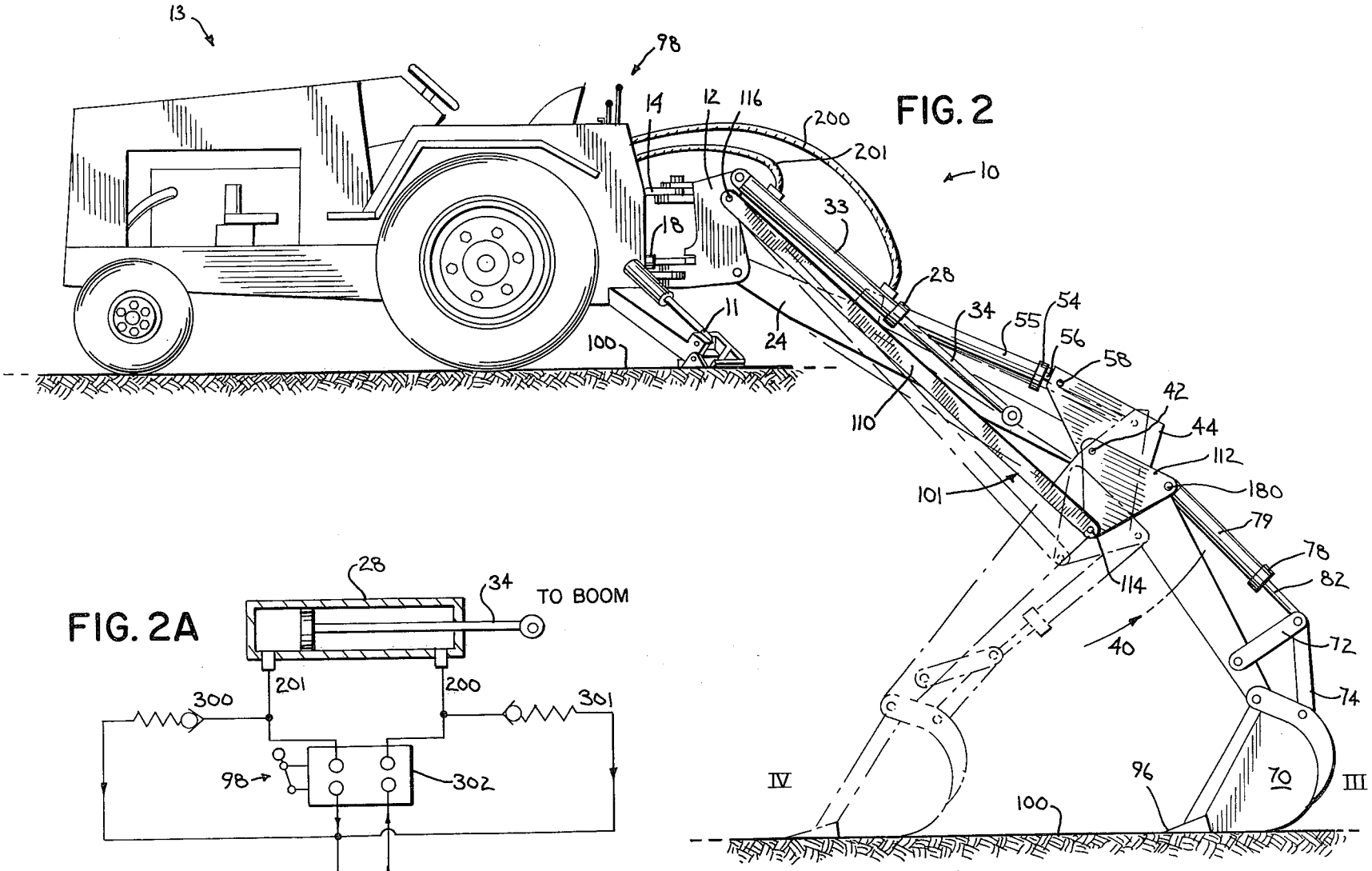
FIG. 2 is an elevational view similar to FIG. 1 showing the same backhoe with the linkage installed that is the subject of the present invention. The dotted lines indicate the machine's position and the relative position of the main components after the bucket has completed its travel across the surface being shovelled.
FIG. 2A is a schematic diagram of a portion of the hydraulic circuit used to manipulate the boom.

FIG. 2 illustrates the same backhoe and tractor 13 as shown in FIG. 1 with the addition of the linkage 101 that is the subject of the present invention. Specifically, an outrigger arm 110 is pivotally connected to a bell crank 112 at a pivot connection 114. The bell crank 114 is formed from a plate in the shape of an equilateral triangle. For balance two bell cranks and two outrigger arms may be installed on either side of the basic backhoe. Only one is shown for clarity. The opposite end of the outrigger arm 110 is joined to the tower 12 on the frame of the tractor 13 supporting the backhoe 10 at a pivot point 116. The other two ends of the bell crank 112 are pivotally joined on the opposite side of the plate 112 to the bucket piston and cyliner assembly 78 and to the pivotal connection 42 between the boom 24 and the dipper stick 40. This enables the arm 110 to swing across the plate 112 without interfering with the actuator 78 positioning the bucket 70. The cylinder 79 of the piston and cylinder assembly 78 operating the bucket 70 and the drive links 72 and 74 on the bucket 70 is pivotally connected to the bell crank 112 at pivot point 180. The remaining end of the bell crank 112 is pivotally joined to the pivotal connection 42 joining the boom 24 with dipper stick 40. From the drawings, it will be noted that the outrigger arm 110 crosses the boom 24 when the boom is fully extended.

In addition, a portion of the hydraulic circuit (See FIG. 2A) directing the operation of the piston and cylinder assembly 28 positioning the boom 24 has been modified. Specifically, the secondary relief valve 300 (normally a part of the control valve manifold 302 directing the operation of the boom 10) has been reset to relieve at a reduced pressure. It will be recalled that the "main relief valve" is a valve used to protect hydraulic system components (such as pumps, valves, cylinders, etc.) when the hydraulic system exceeds a maximum allowable pressure; the relieved oil is returned to the hydraulic oil supply tank. Example: when the main relief valve is set at 2000 PSI (pounds per square inch) the oil going from the system hydraulic pump will be discharged to the hydraulic supply tank without damaging the pump or rupturing any of the associated system seals and components.

In contradistinction, a "secondary relief valve" is a valve to protect individual hydraulic components from a pressure excursion above and beyond the main relief valve setting. This relief valve is used when oil in the component is isolated from the supply tank (ex. in an open center hydraulic control system this would occur when the control handles 98 are in neutral). When the component is isolated, a "hydraulic lock" is in effect and the oil contained within the hydraulic cylinder 28 is shut off from the hydraulic system protected by the main relief. For a hydraulic actuator, normally there is a secondary relief valve 300, 301 for the sealed volume on either side of the piston in that actuator.

For example, in a hydraulic system having an operating pressure of 2300±50 psi, typically the main relief valve would be set for 2350 psi and the secondary relief valves would be set for 2400+200−50 psi. With the linkage just described added to the backhoe, the secondary relief 300 on the side of the hydraulic actuator forced to undergo compression (due to the force applied to the boom 24 tending to retract the boom actuator) would have a setting of 700±75 psi.

Therefore, to operate or to reposition the backhoe 10 from the first position (III) to the second position (IV) shown in FIG. 2, the operator proceeds as follows: First, the bucket 70 is positioned to the desired angle relative to the trench or grade 100. Next, the operator manipulates his controls 98 so as to draw the dipper stick 40 in the direction towards the tractor 13. This motion is accomplished by forcing the piston and cylinder actuator 54 so as to drive the piston rod 56 out of the cylinder 55. Since the tractor 13 and the digging edge 96 of the bucket 70 are relatively fixed with respect to the base of the trench or the grade 100 (i.e. using stabilizers 11) a "toggle action" is produced between the boom 24 and the dipper stick 40. In other words, a force is exerted upwardly at the pivot connection 42 between the boom 24 and the dipper stick 40. This force is translated to a pressure-force within the piston and cylinder assembly 28 directing the positioning of the boom 24. This pressure-force is directed to the hoses and conduit 200, 201 to the control valve 98 for that cylinder. Actuation of the secondary relief valve 300 in the hydraulic circuit for the boom actuator 28 relieves the applied force and allows the boom 24 to rise in a generally upward direction.

Because one end of the bell crank 112 is pivotally joined to the pivotal connection 42 between the boom 24 and the dipper stick 40, the bell crank 112 moves upwardly with the boom 24. Because the center pivot point 114 of the bell crank 112 is held outwardly and away from the tractor 13 by the outrigger arm 101, the other end 180 of the bell crank 112 is forced to move in a generally counterclockwise direction. This "bell crank action" effectively acts to rotate the hydraulic actuator 78 joined to the other end 180 of the bell crank 112 towards the tractor 13. This repositioning of the bucket actuator 78 causes the bucket 70 to extend relative to the dipper stick 40. Then, as the dipper stick 40 passes through the "over-center position", further inward motion of the dipper stick 40 towards the tractor 13 lowers the bell crank 112 while maintaining its relative angular orientation constant. In other words, since the boom 24 and the outrigger arm 110 are rigid or incompressible, the end 180 of the bell crank 112 joined to the bucket actuator 78 remains essentially fixed in space relative to the swing of the dipper stick 40. Continued forward or inward movement of the dipper stick 40 therefore results in the bucket 70 being further extended. Thus, the combination of the rotation of the bucket actuator 78 brought about by bell crank action and the repositioning of the boom 24 brought about by the relieving action of the secondary relief 300 enables the machine operator by manipulation of a single control, the crowd or dipper stick control, to drive the leading edge 96 of bucket 70 in a generally straight line direction along the surface 100 of the trench. This is illustrated in phantom (IV) in FIG. 2.

To remove the particles of dirt and soil that have filled the bucket 70, the backhoe operator needs only to manipulate his bucket control so as to extend the piston and cylinder assembly 78 operating the bucket 70. This "curls" the bucket 70 relative to the dipper stick 40. To remove the dipper stick 40 from the trench, the operator then only needs to operate his boom control so as to raise the boom 24 upwardly. Again, by "bell crank action," the position of the dipper stick 40 and the bucket 70 is maintained relatively constant throughout the cycle of lifting the dipper stick 40 and bucket 70 from the trench. Finally, to discharge his load the operator need only to extend his dipper stick 40 and uncurl the bucket 70. Thus, the operation of levelling a trench has been reduced to the manipulation of a single control.

Figure 3:
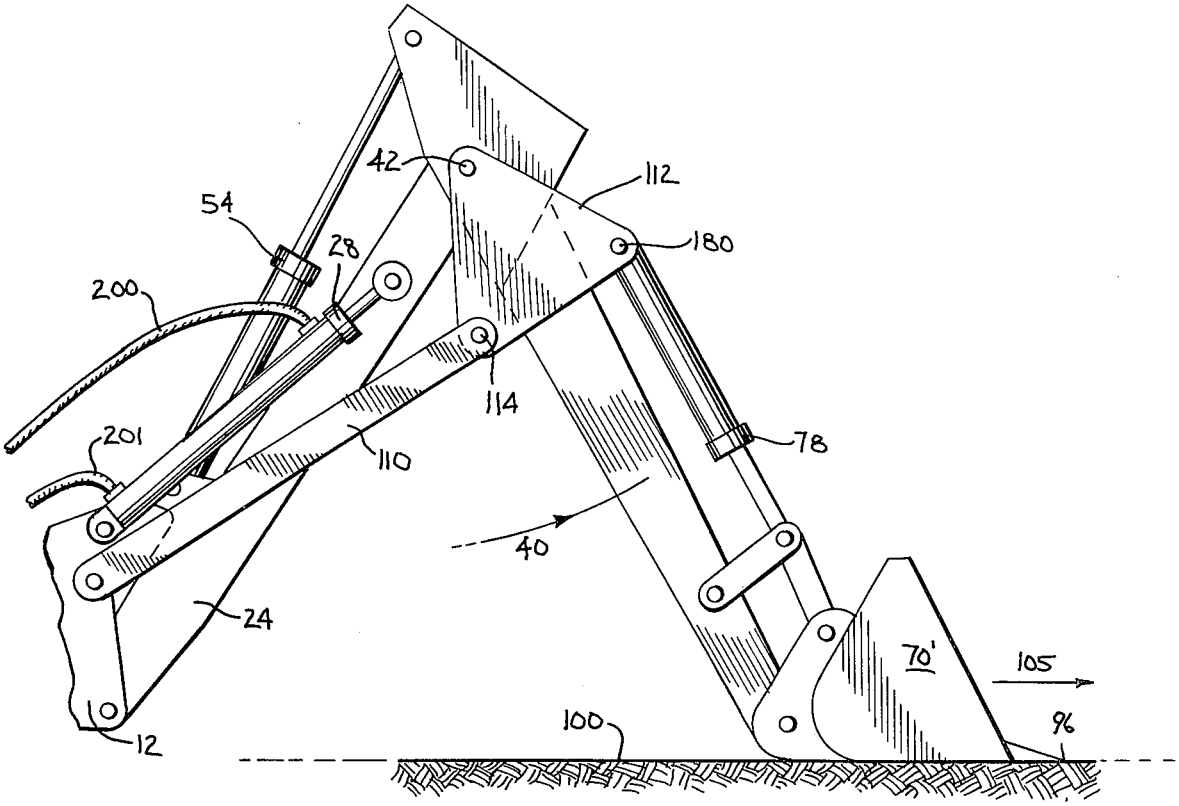
FIG. 3 is right side elevational view of a variation of the apparatus shown in FIG. 2 wherein the position of the bucket is reversed so as to be used as a loader.

FIG. 3 illustrates the incorporation of the bell crank 112 and outrigger arm 110 to a dipper shovel 70'. This configuration is basically the same as that shown in FIG. 2 with the exception that the bucket 70 has been reversed. Under this configuration, the self-levelling feature provided by the outrigger arm 110 and the bell crank 112 allows the operator to make a forward thrust, arrow 105, using the boom control alone while the bucket 70' is maintained in an essentially level position along the grade. Once the bucket 70' is filled with material, it can be curled inwardly towards the dipper stick 40. The self-levelling feature will keep the bucket 70' at essentially same position relative to the grade 100. The boom 24 and dipper stick 40 can then be raised to the position for dumping.

As can be appreciated, the same bell crank and outrigger arm feature could also be incorporated on larger hydraulic excavators or other material handling machines incorporating a boom and dipper stick linkage. In each case, the bell crank and outrigger linkage increases the productivity and ease of operation of the machine. In addition, it increases the cycle time of the machine while reducing operator effort and relieving the amount of control valve feathering required to produce a smooth level trench or to remove and discharge soil.

From the foregoing, it will be observed that numerous variations and modifications may be effected without departing from the true spirit and scope of the novel concept of the invention. Specific sizes and dimensions of the outrigger arm 110 and the bell crank 112 are dependent upon the specific machine to which the linkage 101 is attached. The basic proportions and relationships are shown in the drawings. It is to be understood that no limitation with respect to the specific apparatus illustrated herein is intended or should be inferred. It is, of course, intended to cover by the appended claims all such modifications as fall within the scope of the claims.

What is claimed is:

1. Material handling apparatus for an offroad machine having a frame, comprising:

(a) a bucket having an inner end and an outer end with said outer end resting along the base of a trench;

(b) a pair of drive links, pivotally joined together to form a V-shaped articulated joint with two arms with one arm of said articulated joint pivotally connected to the inner end of said bucket;

(c) a bucket hydraulic piston drive having one end pivoted to the apex of said articulated linkage;

(d) a dipper stick pivoted at one end to the inner end of said bucket and to the second arm of said articulated drive links in a spaced relationship to the end of said dipper stick joined to said bucket, displacement of said drive links at their common intersection having the effect of rotating said bucket on said dipper stick;

(e) a boom, said boom being pivotally joined at one end to the frame of said machine and pivotally joined at the other end to said dipper stick, said dipper stick having a free end extending beyond said pivotal connection to said boom;

(f) a dipper stick hydraulic piston drive connected between the free end of said dipper stick and said boom;

(g) a bell crank with one end of said bell crank pivotally joined to said bucket hydraulic piston drive and with the second end of said bell crank joined to said pivotal connection between said dipper stick and said boom, said bell crank redirecting the force applied to said bucket and said bucket hydraulic piston drive in the direction of said boom;

(h) an outrigger arm having one end pivotally joined to the center of said bell crank with the other end pivotally joined to said frame, the spaced relationship between said outrigger arm and said boom at said frame being such that said outrigger arm is positioned above the pivotal connection of said boom to said frame, said outrigger arm cooperating with said boom to induce rotation to said bell crank and the bucket hydraulic piston drive attached thereto; and (i) a boom hydraulic piston drive connected between said frame and said boom, said boom drive having a relief valve discharging hydraulic fluid in the event said boom drive is forced to contract with a hydraulic lock in effect between the two sides of the piston and cylinder forming said boom drive, discharge of said fluid having the effect of repositioning said boom in the direction of the applied force, said bell crank and outrigger arm dimensioned in relationship to each other such that, within a predetermined range of angles of slope, said bucket is guided along the base of said trench by activation of said dipper stick hydraulic piston drive.

2. In a machine having a boom, a dipperstick, a bucket, a hydraulic system including piston and cylinder actuators to manipulate said boom said dipperstick and said bucket, the hydraulic actuator manipulating said boom having a relief valve in fluid communication with the cylinder portion of said actuator, and a base, said boom being pivotally joined to said base and said hydraulic actuator manipulating said boom being pivoted to said base, wherein the improvement comprises: the addition of a bell crank and outrigger arm, said outrigger arm having one end pivotally connected to the center of said bell crank and the opposite end pivotally connected to said base with the pivotal connection of said outrigger arm to said base positioned above the pivotal connection of said boom to said base, said bell crank having one end pivotally connected to the pivot connection between said boom and said dipper stick and the opposite end of said bell crank pivotally connected to the piston and cylinder actuator manipulating said bucket, said bell crank and outrigger arm linkage cooperating with said relief valve to the extent that upon positioning said bucket at a fixed angle along the grade manipulation of said dipperstick so as to draw said dipperstick towards said boom and along said grade forces said relief valve to open thereby permitting said boom to raise relative to the grade, said bell crank repositioning said bucket via the bucket hydraulic actuator so as to maintain the leading edge of said bucket along said grade without the manipulation of the hydraulic actuator operating said bucket or the hydraulic actuator operating said boom.

3. Material handling apparatus, comprising:

(a) a supporting frame;

(b) a boom pivotally mounted on said supporting frame;

(c) a dipper stick pivotally mounted on said boom intermediate the ends of said dipper stick;

(d) a material handling member carried by the free end of said dipper stick and resting along a grade level on the earth;

(e) first hydraulic means for actuating the dipper stick to pivot said dipper stick relative to said boom; and for pivoting said material handling element relative to said dipper stick;

(f) second hydraulic means including a piston and cylinder actuator pivotally connected between the boom and said frame for actuating the boom to pivot said boom relative to said supporting frame and for pivoting said material handling element relative to said dipper stick to move the material handling element towards and away from said supporting frame; and (g) bell crank means, responding to said first hydraulic means, whereby the application of force to said piston relative to said cylinder induces pivotal movement of the boom relative to the support frame coincident with said bell crank means repositioning said material handling element in accordance with the angular position of said dipper stick relative to said boom so as to maintain said material handling member generally parallel to said grade.

4. Apparatus for an offroad machine to be used in material handling, excavation operations and the like, comprising:

(a) a support frame joined to said machine;

(b) a boom pivotally mounted on said support frame;

(c) a dipper stick pivotally joined to said boom at a point intermediate the ends of said dipper stick;

(d) a material handling member carried by the free end of said dipper stick and positioned with its digging edge resting along the grade;

(e) hydraulic means including a first piston and cylinder actuator pivotally connected between said boom and said support frame for actuating: the dipper stick to pivot said dipper stick relative to said boom; the boom to pivot said boom relative to said supporting frame; and the material handling element to pivot said material handling element relative to said dipper stick, said hydraulic means moving the material handling element towards and away from said supporting frame; and (f) bell crank means, carried by said hydraulic means and said support frame, for moving the end of said boom relative to the support frame and the material handling member relative to said dipper stick as said dipper stick is repositioned relative to said boom by inducing retraction of said piston relative to said cylinder and having the effect of pivotally moving the boom relative to said support frame, said bell crank means repositioning said material handling element in a path generally parallel to said grade without manipulation of said boom.

5. The apparatus defined in claim 4, wherein: a second piston and cylinder actuator is pivotally connected between said material handling member and one end of said bell crank means and the other end of said bell crank means is pivotally connected to said pivot connection between said boom and said dipperstick.

6. The apparatus defined in claim 5, further including a pair of drive links pivotally joined together with: one arm pivotally joined to said material handling member; with the other arm pivotally joined to said dipperstick; and with one end of said second piston and cylinder actuator connected to the joint between said drive links.

7. The apparatus defined in claim 5, wherein said bell crank means includes:

(a) a bell crank; and (b) an outrigger arm having one end pivotally connected to said support frame and the other end of said arm pivotally connected to the center pivotal connection on said bell crank with one of the two remaining pivotal connections on said bell crank joined to said pivotal connection between said boom and said dipper stick and with the remaining pivotal connection on said bell crank joined to said second piston and cylinder actuator.

8. The apparatus defined in claim 7, wherein: one end of said outrigger arm is pivotally joined to said support frame at a spaced distance above the pivotal connection joining said boom to said support frame with the axis of said outrigger arm crossing the axis of said boom with said first piston and cylinder actuator fully extended.

9. The apparatus defined in claim 7, wherein: said bell crank is formed by an equilateral triangular plate having its apex pivotally connected to said outrigger arm with one end of the base of said triangle pivotally joined to said pivotal connection between said boom and said dipper stick and with the other end of the base of said triangle pivotally joined to said second piston and cylinder actuator.

10. The apparatus defined in claim 9, wherein: all three sides of said triangular plate are generally of the same length.

11. The apparatus defined in claim 10, wherein: the length of each side of said plate is generally equal to twice the maximum perpendicular distance between said dipperstick and the end of said second piston and cylinder actuator which is pivotally joined to said material handling member.

12. The apparatus defined in claim 4, wherein said hydraulic means includes a relief valve, said relief valve relieving the pressure built-up within said first piston and cylinder due to the application of force to said boom by said bell crank means, said bell crank means repositioning said boom in response to pivotal motion of said dipperstick and said material handling element along said grade.

13. The apparatus defined in claim 4, wherein: said hydraulic means includes a hydraulic system incorporating an open center control valve to position said first piston and cylinder actuator, said first hydraulic actuator being isolated from said hydraulic system with said control valve in the center position thereby hydraulically locking the position of said boom relative to said frame, said control valve incorporating a relief valve to discharge the pressure built up within said actuator by the force applied to said actuator by said bell crank means.

* * * * *